US008471538B2

(12) United States Patent
Pancholi et al.

(10) Patent No.: US 8,471,538 B2
(45) Date of Patent: Jun. 25, 2013

(54) CONTROLLED LOAD REGULATION AND IMPROVED RESPONSE TIME OF LDO WITH ADAPTIVE CURRENT DISTRIBUTION MECHANISM

(75) Inventors: Deepak Pancholi, Bangalore (IN); Bhavin Odedara, Kodihalli (IN); Naidu Prasad, New Tippasandra (IN)

(73) Assignee: SanDisk Technologies Inc., Plano, TX (US)

( * ) Notice: Subject to any disclaimer, the term of this patent is extended or adjusted under 35 U.S.C. 154(b) by 570 days.

(21) Appl. No.: 12/693,228

(22) Filed: Jan. 25, 2010

(65) Prior Publication Data

US 2011/0181257 A1 Jul. 28, 2011

(51) Int. Cl.
*G05F 1/00* (2006.01)

(52) U.S. Cl.
USPC ..... 323/274; 323/314

(58) Field of Classification Search
USPC ..... 323/268, 269, 270, 271, 272, 273, 323/274, 312, 313, 314, 315, 316, 317, 280; 327/538, 539, 540, 541, 542, 543
See application file for complete search history.

(56) References Cited

U.S. PATENT DOCUMENTS 5,841,270 A * 11/1998 Do et al. ..... 323/314
6,144,195 A * 11/2000 Afghahi et al. ..... 323/314
6,518,737 B1 2/2003 Stanescu et al.
6,700,360 B2 3/2004 Biagi et al.
7,323,853 B2 1/2008 Tang et al.
7,362,081 B1 4/2008 Huang
7,391,196 B2 6/2008 Fosler
7,612,548 B2 * 11/2009 Jian ..... 323/280
8,004,253 B2 8/2011 Beltran
2002/0060560 A1 5/2002 Umemoto
2003/0111986 A1 * 6/2003 Xi ..... 323/280
2004/0021450 A1 2/2004 Wrathall
2004/0164789 A1 8/2004 Leung et al.

(Continued)

FOREIGN PATENT DOCUMENTS

EP 0864956 A2 9/1998

OTHER PUBLICATIONS

"500mA CMOS LDO Regulator," Catalyst Semiconductor, Inc., CAT6219, May 20, 2008, 10 pages.

*Primary Examiner* — Nguyen Tran
(74) *Attorney, Agent, or Firm* — Davis Wright Tremaine LLP

(57) ABSTRACT

A low drop-out (LDO) voltage regulation circuit includes first and second internal current paths. The first internal current path is between the input supply voltage and ground and includes the regulator's buffer circuit. The second internal current path is between the input supply voltage and ground and includes the regulator's power transistor. The amount of current flowing through the first internal current path relative to the amount of current flowing through the second internal current path is an increasing function of a current supplied to a load connected to the output supply node. The load regulation of the LDO is improved as the DC gain will not go down at lower load currents. Further, the no load to full load response time is improved as the load pole and power MOS gate pole are actively controlled with respect to output load current. In this mechanism, as the amount of current being supplied to the load decreases, the internal current flow shifts from the first internal current path to the second internal current path and vice versa. This arrangement maintains the desired pole structure and keeps the quiescent current largely the same for all load current levels.

27 Claims, 3 Drawing Sheets

U.S. PATENT DOCUMENTS

2006/0170404 A1 8/2006 Amrani et al.
2008/0203981 A1 8/2008 Itoh et al.
2009/0033310 A1* 2/2009 Erbito, Jr. ..... 323/313
2009/0102444 A1 4/2009 Nonaka
2009/0224827 A1 9/2009 Tadeparthy et al.
2009/0302812 A1* 12/2009 Shor et al. ..... 323/223

* cited by examiner

Low $I_{load}$ Path
High $I_{load}$ Path
$V_{out}$
$V_{ref}$
$R_{load}$
195
$C_{load}$
193
$R_2$
107
$R_1$
104
Z
MP0
105
113
$I = f(V_x)$
MP2
111
Y
MP3
131
MP1
133
103
X
$R_z$
151
$C_z$
153
101
Amp
-
+

CONTROLLED LOAD REGULATION AND IMPROVED RESPONSE TIME OF LDO WITH ADAPTIVE CURRENT DISTRIBUTION MECHANISM

FIELD OF THE INVENTION

This invention pertains generally to the field of voltage regulation circuits and, more particularly, to low drop out (LDO) regulators and controlling the regulation of their load.

BACKGROUND

Voltage regulation circuits have many applications in power supply systems to provide a regulated voltage at a predetermined multiple of a reference voltage. In low drop-out regulator designs, there commonly occur two poles at lower frequencies, one due to the output impedance of the circuit's power MOS transistor together with load capacitor and another due to the gate capacitance of the power MOS with impedance connected to this node. These two poles come very close to each other in many designs. One way to separate these poles is to increase the value of a load capacitor, so as to move the load pole towards the lower frequencies. However, this increases the cost of this capacitor and it needs the board area. In many applications, this needed increase in board area can be very difficult to come by. It also results in reduction of loop bandwidth and, hence, reduction in response time. Another way to separate these poles is to increase the current the regulator's buffer stage, to thereby reduce the impedance in that arm of the circuit and move the power MOS pole towards the higher frequencies. Although this again helps to separate the poles, it is done at the cost of increased quiescent current of the LDO for all loads. As both of these approaches have drawbacks, there is consequently room for improvement in the design of low drop out regulation circuits.

SUMMARY OF THE INVENTION

According to a general aspect of the invention, a voltage regulator circuit is presented. The regulator includes a power transistor, connected between an input supply voltage and an output supply node, and an error amplifier having a first input connected to receive a reference voltage and a second input connected to a feedback node. The error amplifier provides an output derived from the inputs. A buffer circuit is connected between the input supply voltage and ground and is also connected to receive the output of the error amplifier. The buffer circuit has an output derived from the output of the error amplifier and which is connected to control the gate of the power transistor. A voltage divider circuit is connected between the output node and ground and the feedback node is taken from a node of the voltage divider. The voltage regulator also includes a first diode, connected between the input supply voltage and the output node of the buffer circuit, and a current sinking circuit connected between the output supply node and ground. The amount of current being sunk is a decreasing function of the current being supplied at the output supply node.

According to another general aspect of the invention, a voltage regulator circuit is presented. The regulator includes a power transistor, connected between an input supply voltage and an output supply node, and an error amplifier having a first input connected to receive a reference voltage and a second input connected to a feedback node. The error amplifier provides an output derived from the inputs. A buffer circuit is connected between the input supply voltage and ground and is also connected to receive the output of the error amplifier. The buffer circuit has an output derived from the output of the error amplifier and which is connected to control the gate of the power transistor. A voltage divider circuit is connected between the output node and ground and the feedback node is taken from a node of the voltage divider. The voltage regulator also includes a first diode, connected between the input supply voltage and the output node of the buffer circuit, and a current sinking circuit connected between the output supply node and ground. The amount of current being sunk is a function of the voltage level at the output of the error amp.

Other aspects present a voltage regulation circuit having a power transistor, connected between an input supply voltage and an output supply node, a buffer circuit, connected between ground and the input supply, and an error amplifier. The error amplifier has an output connected to control the gate of the output power transistor through the buffer circuit, a first input connected to receive a reference voltage, and a second input connected to receive feedback dependent upon the voltage level at the output node. The voltage regulator circuit includes first and second internal current paths. The first internal current path is between the input supply voltage and ground and includes the buffer circuit. The second internal current path is between the input supply voltage and ground and includes the power transistor. The amount of current flowing through the first internal current path relative to the amount of current flowing through the second internal current path is an increasing function of a current supplied to a load connected to the output supply node.

Various aspects, advantages, features and embodiments of the present invention are included in the following description of exemplary examples thereof, whose description should be taken in conjunction with the accompanying drawings. All patents, patent applications, articles, other publications, documents and things referenced herein are hereby incorporated herein by this reference in their entirety for all purposes. To the extent of any inconsistency or conflict in the definition or use of terms between any of the incorporated publications, documents or things and the present application, those of the present application shall prevail.

DETAILED DESCRIPTION

The techniques presented in the following provide a low drop-out (LDO) voltage regulation circuit that improves upon many of the limitations described above in the Background section. In particular, the load regulation in the exemplary embodiment of an LDO will improve as the DC gain will not go down at lower load currents. Further, the no load to full load response time is improved as the load pole and power MOS gate pole are actively controlled with respect to output load current. In this mechanism, as the amount of current being supplied to the load decreases, the internal current flow shifts from a first internal current path to a second internal current path and vice versa. This arrangement maintains the desired pole structure and keeps the quiescent current largely the same for all load current levels.

Figure 1:
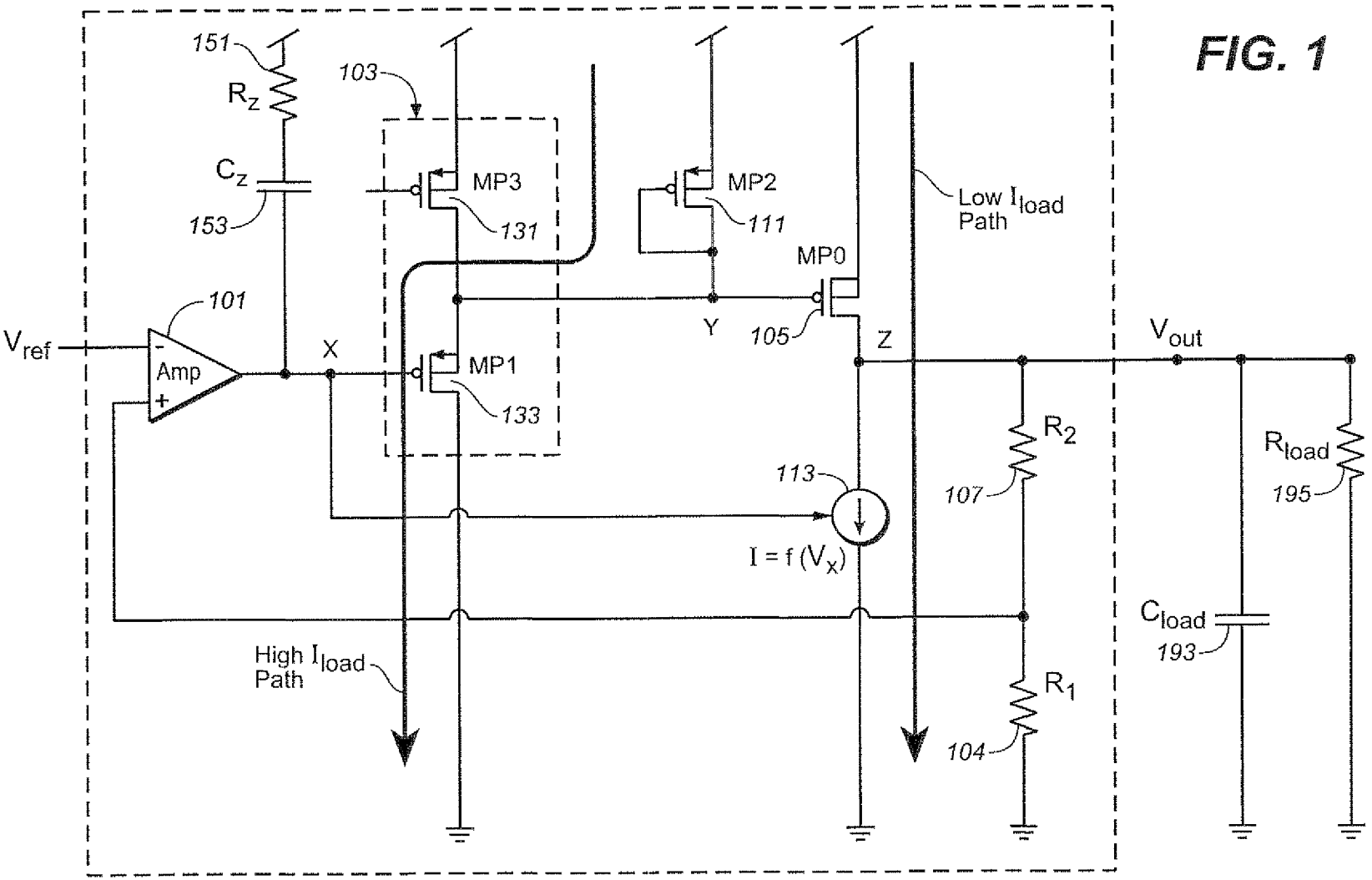
FIG. 1 is a block diagram of an exemplary embodiment.

More specifically, FIG. 1 is an exemplary embodiment to illustrate some aspects. Relative to a typical implementation of an LDO regulator, the mechanism presented here connects an additional PMOS device (shown as MP2 111) as a diode arranged in parallel to the smaller current source PMOS MP3 131. The prior art arrangements, without the additional device MP2 111, required a higher current through the device MP3 131 during any load operation; but at the lower load current (through the load represented by Rload 195), the major pole (due to load capacitor Cload 193 attached at the output) moves inside and pole separation happens naturally. In the mechanism introduced here, though the PMOS MP3 131 can be kept at the very minimal current level that is needed at lower load currents. When the external load current increases, the gate voltage of power MOS MP0 105 (at the output node of the buffer 103) decrease, so that the voltage across the diode connected PMOS MP2 111 will increase, as, consequently, the current through it. This compensates the higher current requirement of the buffer stage, which helps in pushing the power MOS MP0 105 gate pole outside. In this way, the quiescent current at lower loads is reduced.

Figure 2:
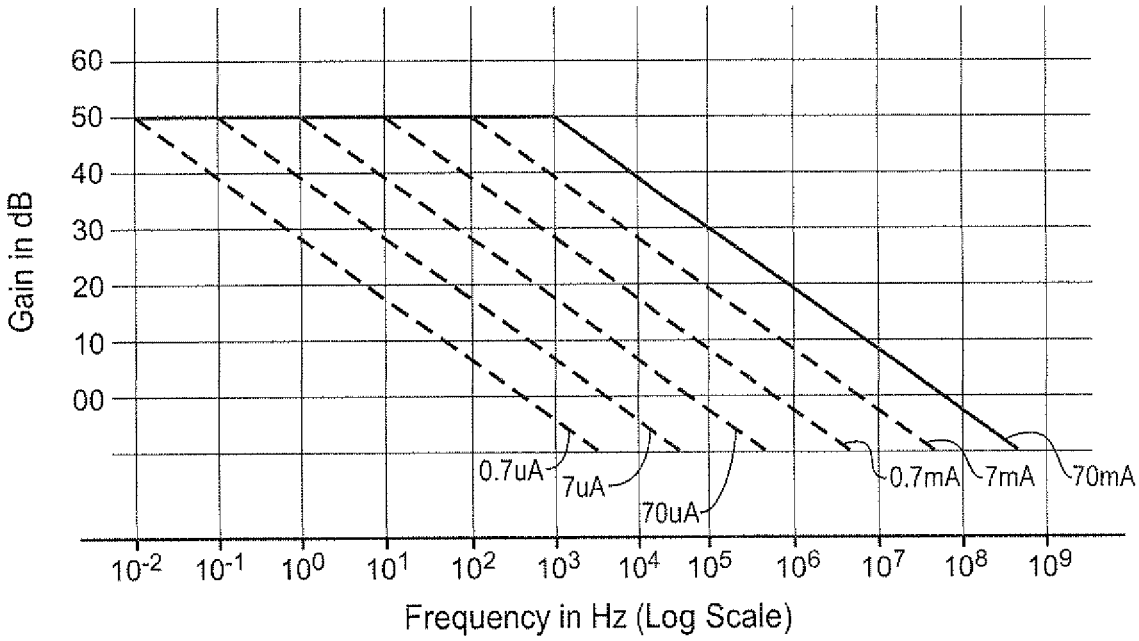
FIG. 2 illustrates the AC gain variations typical of the prior art.

In addition to the diode MP2 111, the preferred embodiment includes an addition to the circuit which utilizes the quiescent current to improve the load regulation. In the conventional LDO circuits the DC gain of the LDO drop significantly at lower loads, an effect that is illustrated in FIG. 2. FIG. 2 shows this typical AC gain variation, where the gain in decibels is on the vertical axis and frequency is shown on the horizontal axis. The behavior is illustrated for current loads of from 0.7 μA to 70 mA and, as shown, as the current load decreases the gain drops off significantly at progressively lower frequencies. To overcome this behavior, the exemplary adds an additional current source 113 having a current level dependent upon output voltage of the error amp 101, I=f(Vx), that sinks the current from the drain of power MOS MP0 105 inversely to the load current. This can keep the DC gain from dropping off as described with respect to FIG. 2 and help to ensure that the major pole (due to the load capacitor Cload 193 connected between the output node Z and ground) does not go very much inside.

Considering FIG. 1 further, an error amplifier 101, which can be of any of the typical design used for an LDO regulator has a first input connected to a reference voltage Vref from, for example, a band gap circuit and a second input connected to receive feedback. The output of the error amp AMP 101 (node X) is feed through the buffer circuit 103 to control the gate of the power PMOS transistor MP0 105. The power transistor MP0 105 is connected between the supply level and the output node (node Z) to supply Vout. The buffer circuit 103 here uses a source follower arrangement, with the output of the error amp 101 at node X connected to the gate of MP1 133, which is connected between ground and, through current source MP3 131, to the input supply. The output of the buffer 103 at node Y is then supplied to the gate of the power transistor MP0 105 to set the level Vout at node Z. The feedback for AMP 101 is taken from a voltage divider circuit connected between Vout and ground, here formed from a node between a first resistance R2 107 and second resistance R1 109. The exemplary embodiment also includes a resistance Rz 151 and capacitor Cz 153 to provide an additional zero to help in stability of the regulator.

The elements of FIG. 1 described in the preceding paragraph are largely conventional. Except for the example of the series connected resistance Rz 151 and capacitor Cz 153 between node X and the high supply level to help further in the stability of the regulator, other common elements could also be included, but are suppressed here to simplify this discussion. Other arrangements may also be used for the voltage divider circuit, rather the pair of series resistances shown here: see, for example, U.S. patent application Ser. No. 12/632,998 filed on Dec. 8, 2009.

The additional elements added to FIG. 1 include the diode element MP2 111 and the current sink circuit 113. The diode connected PMOS MP2 111 is connected in series with MP3 131 between the input supply voltage level and node Y. At high load currents, the internal current in the regulation circuit follows the path through the diode MP2 111 in parallel with current source MP3 131 to node Y and through transistor MP1 133 of the buffer circuit 103 to ground. The current sink circuit 113 is connected between the output node (node Z) and ground and also is connected to node X at the output of the error amp 101. The amount of current being sunk from the node Z by this current sink circuit 113 is a function of the level at node X, Vx, with the result that the amount of current flowing through I=f(Vx) 113 is a decreasing function of the current being supplied to the load through the output node. Under this arrangement, the internal current path for low load current values shifts to the shown "Low I path" through the power transistor MP0 105 and the current sinking circuit 113 to ground. In this way, as the amount of current being supplied to the load decreases, the internal current flow shifts from the "High I path" to the "Low I path" and vice versa. This arrangement maintains the desired pole structure without the sort of drop-off in gain described with respect to FIG. 2 and without the need to maintain a higher quiescent current level through the buffer stage 103 for all load current levels.

Figure 3:
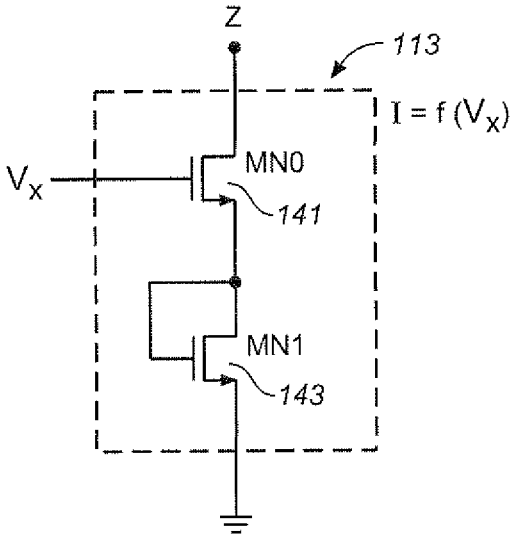
FIGS. 3 and 4 are embodiments of the current sinking circuit of FIG. 1.

The I=f(Vx) circuit 113 can be implemented in various ways, a first embodiment of which is shown in FIG. 3. As shown in FIG. 3, the I=f(v) circuit can be realized by "Vgs" controlled diode shown by transistors MN0 141 and MN1 143. The gate-source voltage Vgs of the NMOS MN0 141 will control the voltage across the MN1 device 143. The width to length ratio of MN0 141 can be chosen such that drain-source voltage, Vds, across the diode connected MN1 143 is lower than its threshold voltage when the load current is at the maximum end of its range (here taken as 70 mA), such that little current (i.e, in the nano-amp range) is taken by this system. When the load current decreases, the gate voltage of MN0 141 increases and the Vds of diode MN1 143 goes higher than its threshold voltage, causing the current through the system 113 to increase (i.e., on the order of 100-150 μA), such that the load pole is not pushed inside.

Figure 4:
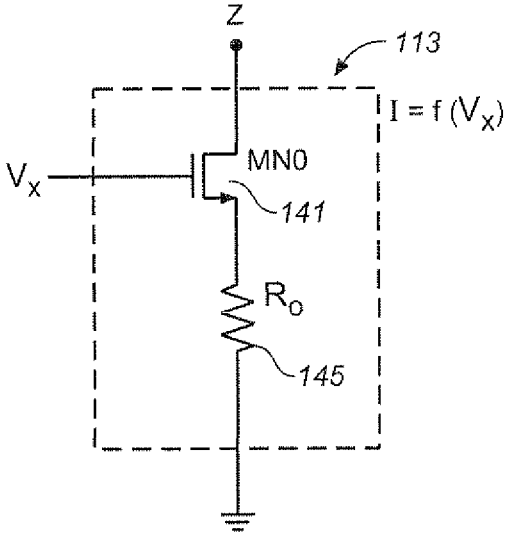

An alternate embodiment for the I=f(Vx) circuit 113 is shown in FIG. 4. In FIG. 4, a resistor R0 145 is now connected between MN0 141 and ground, rather than the diode MN1 143 of the embodiment of FIG. 3. The mechanism is now implemented by the gate-source voltage Vgs of MN0 141 together with resistor R0 145. For either of these exemplary embodiments, for low load current levels, something on the order of 100-150 uA of current through the current sinking circuit 113 is used to increase the DC gain and bandwidth at lower load currents, which in turn improves the load regulation and also results in faster response time. Consequently, the mechanism presented here, where a pair of internal current paths are introduced such their relative current levels shifts between them depending on the load current, controls the load regulation and improves the response time from no load to full load without increasing the required quiescent current.

Figure 5:
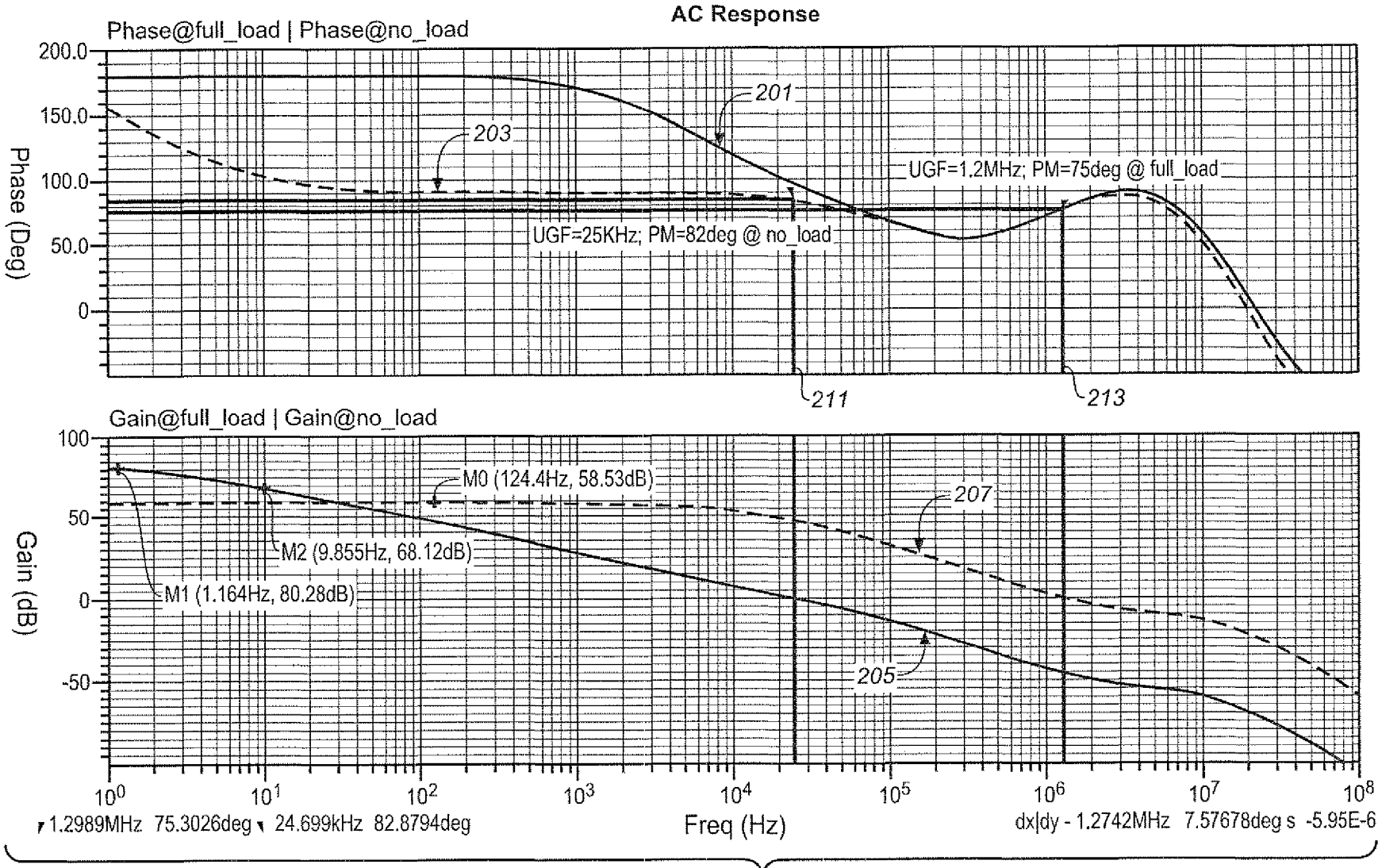
FIG. 5 illustrates AC stability results for the diode based embodiment of FIG. 3

The AC stability results for the diode based embodiment of FIG. 3 are shown in FIG. 5 at full load current (~70 mA) and no load. The phase as a function of frequency for the full load current is shown at 201, with the gain as function of frequency at 207. The gain drops to 0 db at just over $10^6$ Hz at the line 213, where the phase margin is at 75 degrees. For no load current, the phase as function of frequency is shown at 203, with the gain as function of frequency at 205. The gain drops to 0 db at ~25 Hz at the line 211, where the phase margin is at 82 degrees.

The foregoing detailed description of the invention has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application, to thereby enable others skilled in the art to best utilize the invention in various embodiments and with various modifications as are suited to the particular use contemplated. It is intended that the scope of the invention be defined by the claims appended hereto.

The invention claimed is:

1. A voltage regulation circuit, comprising:

a power transistor connected between an input supply voltage and an output supply node;

an error amplifier having a first input connected to receive a reference voltage and a second input connected to a feedback node, the error amplifier providing an output derived from the inputs;

a buffer circuit connected between the input supply voltage and ground, the buffer circuit connected to receive the output of the error amplifier and having an output derived therefrom connected to control the gate of the power transistor;

a voltage divider circuit connected between the output supply node and ground, the feedback node taken from a node of the voltage divider;

a first diode, connected between the input supply voltage and the output of the buffer circuit; and a current sinking circuit connected between the output supply node and ground, wherein the amount of current being sunk is a decreasing function of the current being supplied at the output supply node.

2. The voltage regulation circuit of claim 1, wherein the current sinking circuit includes a first transistor connected between the output supply node and ground and having a gate controlled by the output of the error amplifier.

3. The voltage regulation circuit of claim 2, wherein the current sinking circuit further includes a second diode, wherein the first transistor is connected to ground through the second diode.

4. The voltage regulation circuit of claim 2, wherein the current sinking circuit further includes a resistance, wherein the first transistor is connected to ground through the resistance.

5. The voltage regulation circuit of claim 1, wherein the first diode is formed of a diode connected PMOS transistor.

6. The voltage regulation circuit of claim 1, wherein the voltage divider circuit includes a first resistance and a second resistance connected in series between the output node and ground, the feedback node taken from between the first and second resistances.

7. The voltage regulation circuit of claim 1, wherein the buffer circuit is a source follower circuit.

8. The voltage regulation circuit of claim 7, wherein the buffer circuit includes:

a current source connected between the input supply voltage and a first node; and a first transistor connected between the first node and ground and having a gate connected to the output of the error amplifier, wherein the gate of the power transistor is connected to the first node.

9. A voltage regulation circuit, comprising:

a power transistor connected between an input supply voltage and an output supply node;

an error amplifier having a first input connected to receive a reference voltage and a second input connected to a feedback node, the error amplifier providing an output derived from the inputs;

a buffer circuit connected between the input supply voltage and ground, the buffer circuit connected to receive the output of the error amplifier and having an output derived therefrom connected to control the gate of the power transistor;

a voltage divider circuit connected between the output supply node and ground, the feedback node taken from a node of the voltage divider;

a first diode, connected between the input supply voltage and the output of the buffer circuit; and a current sinking circuit connected between the output supply node and ground and to receive the output of the error amplifier, wherein the amount of current being sunk is a function of the voltage level at the output of the error amp.

10. The voltage regulation circuit of claim 9, wherein the current sinking circuit includes a first transistor connected between the output supply node and ground and having a gate controlled by the output of the error amplifier.

11. The voltage regulation circuit of claim 10, wherein the current sinking circuit further includes a second diode, wherein the first transistor is connected to ground through the second diode.

12. The voltage regulation circuit of claim 10, wherein the current sinking circuit further includes a resistance, wherein the first transistor is connected to ground through the resistance.

13. The voltage regulation circuit of claim 9, wherein the first diode is formed of a diode connected PMOS transistor.

14. The voltage regulation circuit of claim 9, wherein the voltage divider circuit includes a first resistance and a second resistance connected in series between the output node and ground, the feedback node taken from between the first and second resistances.

15. The voltage regulation circuit of claim 9, wherein the buffer circuit is a source follower circuit.

16. The voltage regulation circuit of claim 15, wherein the buffer circuit includes:

a current source connected between the input supply voltage and a first node; and a first transistor connected between the first node and ground and having a gate connected to the output of the error amplifier, wherein the gate of the power transistor is connected to the first node.

17. A voltage regulation circuit, comprising:

a power transistor, connected between an input supply voltage and an output supply node;

a buffer circuit connected between ground and the input supply;

an error amplifier, having an output connected to control the gate of the output power transistor through the buffer circuit, a first input connected to receive a reference voltage, and a second input connected to receive a feedback dependent upon the voltage level at the output node;

a first internal current path between the input supply voltage and ground and that includes the buffer circuit; and a second internal current path between the input supply voltage and ground and that includes the power transistor, wherein the amount of current flowing through the first internal current path relative to the amount of current flowing through the second internal current path is an increasing function of a current supplied to a load connected to the output supply node.

18. The voltage regulation circuit of claim 17, where the first internal current path further includes a diode connected between the input supply voltage and the buffer circuit.

19. The voltage regulation circuit of claim 18, wherein the buffer circuit includes:

a current source connected between the input supply voltage and a first node; and a first transistor connected between the first node and ground and having a gate connected to the output of the error amplifier, wherein the diode and the gate of the power transistor are connected to the first node.

20. The voltage regulation circuit of claim 18, where the diode is formed of a diode connected PMOS transistor.

21. The voltage regulation circuit of claim 17, where the second internal current path further includes a current sinking circuit connected between the output supply node and ground.

22. The voltage regulation circuit of claim 21, wherein the amount of current being sunk is a decreasing function of the current being supplied at the output supply node.

23. The voltage regulation circuit of claim 22, wherein the, amount of current being sunk is a function of the voltage level at the output of the error amp.

24. The voltage regulation circuit of claim 21, wherein the current sinking circuit includes a first transistor connected between the output supply node and ground and having a gate controlled by the output of the error amplifier.

25. The voltage regulation circuit of claim 24, wherein the current sinking circuit further includes a diode, wherein the first transistor is connected to ground through the diode.

26. The voltage regulation circuit of claim 24, wherein the current sinking circuit further includes a resistance, wherein the first transistor is connected to ground through the resistance.

27. The voltage regulation circuit of claim 17, further including a voltage divider circuit having a first resistance and a second resistance connected in series between the output node and ground, the feedback taken from between the first and second resistances.

* * * * *